US009070336B2

(12) United States Patent
Chiang et al.

(10) Patent No.: US 9,070,336 B2
(45) Date of Patent: Jun. 30, 2015

(54) LIQUID CRYSTAL DISPLAY COMPRISING PIXEL WITH CHARGE SHARING UNIT AND DISPLAY DRIVING METHOD THEREOF

(75) Inventors: Chia-Lun Chiang, Hsin-Chu (TW); Yu-Sheng Huang, Hsin-Chu (TW); Yan-Ciao Chen, Hsin-Chu (TW); Meng-Ju Tsai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 332 days.

(21) Appl. No.: 13/452,918

(22) Filed: Apr. 22, 2012

(65) Prior Publication Data

US 2013/0100108 A1 Apr. 25, 2013

(30) Foreign Application Priority Data

Oct. 20, 2011 (TW) ..... 100138135 A

(51) Int. Cl.
*G09G 3/36* (2006.01)
*G09G 3/00* (2006.01)

(52) U.S. Cl.
CPC ..... *G09G 3/3659* (2013.01); *G09G 3/003* (2013.01); *G09G 2300/0447* (2013.01); *G09G 2310/0251* (2013.01); *G09G 2320/0209* (2013.01); *G09G 2330/023* (2013.01); *G09G 2300/0852* (2013.01)

(58) Field of Classification Search
CPC ..... G09G 3/3433–3/3696
USPC ..... 345/87–92
See application file for complete search history.

(56) References Cited

U.S. PATENT DOCUMENTS

| | | | | |
|---|---|---|---|---|
| 7,126,573 | B2 * | 10/2006 | Park et al. | 345/94 |
| 7,167,154 | B2 * | 1/2007 | Sato et al. | 345/100 |
| 2008/0284931 | A1 * | 11/2008 | Kimura | 349/39 |
| 2008/0303768 | A1 * | 12/2008 | Do et al. | 345/90 |
| 2009/0135323 | A1 * | 5/2009 | Yang et al. | 349/37 |
| 2009/0225018 | A1 | 9/2009 | Kim | |
| 2010/0156847 | A1 | 6/2010 | No | |
| 2010/0164904 | A1 | 7/2010 | Kim | |
| 2010/0164928 | A1 * | 7/2010 | Shin et al. | 345/211 |
| 2010/0194705 | A1 | 8/2010 | Kim | |
| 2010/0277439 | A1 | 11/2010 | Charlier | |

* cited by examiner

*Primary Examiner* — Roy Rabindranath
(74) *Attorney, Agent, or Firm* — Winston Hsu; Scott Margo

(57) ABSTRACT

A liquid crystal display includes a date line for transmitting a data signal, a first gate line for transmitting a first gate signal, a second gate line for transmitting a second gate signal, a first sub-pixel unit for being written to by a first sub-pixel voltage according to the data signal and the first gate signal, a second sub-pixel unit for being written to by a second sub-pixel voltage according to the data signal and the first gate signal, a third sub-pixel unit for being written to by a third sub-pixel voltage according to the data signal and the first gate signal, and a charge sharing control unit. The charge sharing control unit is utilized for controlling a charge sharing operation over the first and third sub-pixel units according to the second gate signal, thereby adjusting the first and third sub-pixel voltages.

12 Claims, 7 Drawing Sheets

LIQUID CRYSTAL DISPLAY COMPRISING PIXEL WITH CHARGE SHARING UNIT AND DISPLAY DRIVING METHOD THEREOF

BACKGROUND OF THE INVENTION

1. Field of the Invention

The present invention relates to a display device and related driving method, and particularly to a liquid crystal display device and related driving method.

2. Description of the Prior Art

With innovation in display technology, three-dimensional (3D) display technologies have already been developed that allow viewers to experience 3D vision. The 3D technologies send different images to right and left eyes of the viewer, so that the brain can analyze and overlay the images to perceive layers and depth of visual objects, and thereby experience 3D vision. FIG. 1 is a diagram illustrating architecture and method of use of a 3D display device. As shown in FIG. 1, 3D display device 900 comprises pixel array 910 and polarizing panel array 920. Generally speaking, in operation of 3D display device 900, the user must wear polarizing glasses 980 to filter out the left and right eye images. The polarizing glasses 980 has a first polarizing lens 981_R for filtering out the right eye image, and a second polarizing lens 981_L for filtering out the left eye image. Pixel array 910 comprises a plurality of first pixels 911_R for providing a first image, and a plurality of second pixels 911_L for providing a second image. Polarizing panel array 920 comprises a plurality of first polarizing panels 921_R and a plurality of second polarizing panels 921_L, where the first polarizing panels 921_R are used for performing polarization on the first image to generate the left eye image having a first polarization direction, and the second polarizing panels 921_L are used for performing polarization on the second image to generate the right eye image having a second polarization direction. The second polarization direction is orthogonal to the first polarization direction. However, images outputted by pixel border regions of the first pixels 911_R and the second pixels 911_L may bleed from the crevice between the first polarizing panels 921_R and the second polarizing panels 921_L, causing mutually interfering images, and decreasing 3D display quality.

SUMMARY OF THE INVENTION

According to an embodiment, a liquid crystal display (LCD) device comprises a data line for transmitting a data signal, a first gate line for transmitting a first gate signal, a second gate line for transmitting a second gate signal, a first sub-pixel unit electrically connected to the data line and the first gate line, a second sub-pixel unit electrically connected to the data line and the first gate line, a third sub-pixel unit electrically connected to the data line and the first gate line, and a charge sharing control unit electrically connected to the second gate line, the first sub-pixel unit, and the third sub-pixel unit. The first sub-pixel unit is used for being written to by a first sub-pixel voltage according to the data signal and the first gate signal. The second sub-pixel unit is used for being written to by a second sub-pixel voltage according to the data signal and the first gate signal. The third sub-pixel unit is used for being written to by a third sub-pixel voltage according to the data signal and the first gate signal. The charge sharing control unit is for controlling charge sharing between the first sub-pixel unit and the third sub-pixel unit according to the second gate signal, and thereby adjusting the first sub-pixel voltage and the third sub-pixel voltage.

According to an embodiment, a liquid crystal display (LCD) device comprises a data line for transmitting a data signal, a first gate line for transmitting a first gate signal, a second gate line for transmitting a second gate signal, a first sub-pixel unit electrically connected to the data line and the first gate line, a second sub-pixel unit electrically connected to the data line and the first gate line, a third sub-pixel unit electrically connected to the data line and the first gate line, and a reset unit electrically connected to the second gate line. The first sub-pixel unit is used for being written to by a first sub-pixel voltage according to the data signal and the first gate signal. The second sub-pixel unit is used for being written to by a second sub-pixel voltage according to the data signal and the first gate signal. The third sub-pixel unit is used for being written to by a third sub-pixel voltage according to the data signal and the first gate signal. The reset unit is for performing a reset operation on the first sub-pixel voltage of the first sub-pixel unit or the third sub-pixel voltage of the third sub-pixel unit according to the second gate signal.

According to an embodiment, a method of driving a display is for use in driving an LCD device. The LCD device has a 2D/3D switching mechanism and a Multi-domain Vertical Alignment (MVA) mechanism. The LCD device comprises a data line for transmitting a data signal, a first gate line for transmitting a first gate signal, a second gate line for transmitting a second gate signal, a third gate line for transmitting a third gate signal, a first sub-pixel unit electrically connected to the data line and the first gate line, a second sub-pixel unit electrically connected to the data line and the first gate line, a third sub-pixel unit electrically connected to the data line and the first gate line, a charge sharing control unit for controlling charge sharing between the first sub-pixel unit and the third sub-pixel unit according to the second gate signal, and a reset unit for performing a reset operation according to the third gate signal to reset the first sub-pixel voltage or the third sub-pixel voltage. The method comprises, in a first period, providing a first gate pulse of the first gate signal to the first gate line for writing the data signal to the first sub-pixel unit, the second sub-pixel unit, and the third sub-pixel unit, in a second period following the first period, providing a second gate pulse of the second gate signal to the second gate line for enabling the charge sharing control unit, and, in a third period following the second period, providing a third gate pulse of the third gate signal to the third gate line for enabling the reset unit.

According to an embodiment, a method of driving a display is for use in driving an LCD device having a 2D/3D switching mechanism and a Multi-domain Vertical Alignment (MVA) mechanism. The LCD device comprises a data line for transmitting a data signal, a first gate line for transmitting a first gate signal, a second gate line for transmitting a second gate signal, a third gate line for transmitting a third gate signal, a first sub-pixel unit electrically connected to the data line and the first gate line, a second sub-pixel unit electrically connected to the data line and the first gate line, a third sub-pixel unit electrically connected to the data line and the first gate line, a charge sharing control unit for controlling charge sharing between the first sub-pixel unit and the third sub-pixel unit according to the second gate signal, and a reset unit for performing a reset operation according to the third gate signal to reset the first sub-pixel voltage or the third sub-pixel voltage. The method comprises, in a first period, providing a third gate pulse of the third gate signal to the third gate line for enabling the reset unit, in a second period following the first period, providing a first gate pulse of the first gate signal to the first gate line for writing the data signal to the first sub-pixel unit, the second sub-pixel unit, and the third sub-pixel unit, and, in a third period following the second period, providing a second gate pulse of the second gate signal to the second gate line for enabling the charge sharing control unit.

These and other objectives of the present invention will no doubt become obvious to those of ordinary skill in the art after reading the following detailed description of the preferred embodiment that is illustrated in the various figures and drawings.

DETAILED DESCRIPTION

In the following, a liquid crystal display (LCD) device and related driving method are described in detail in various exemplary embodiments with reference to the figures. However, the embodiments provided are not intended to limit the scope of the invention.

Figure 1:
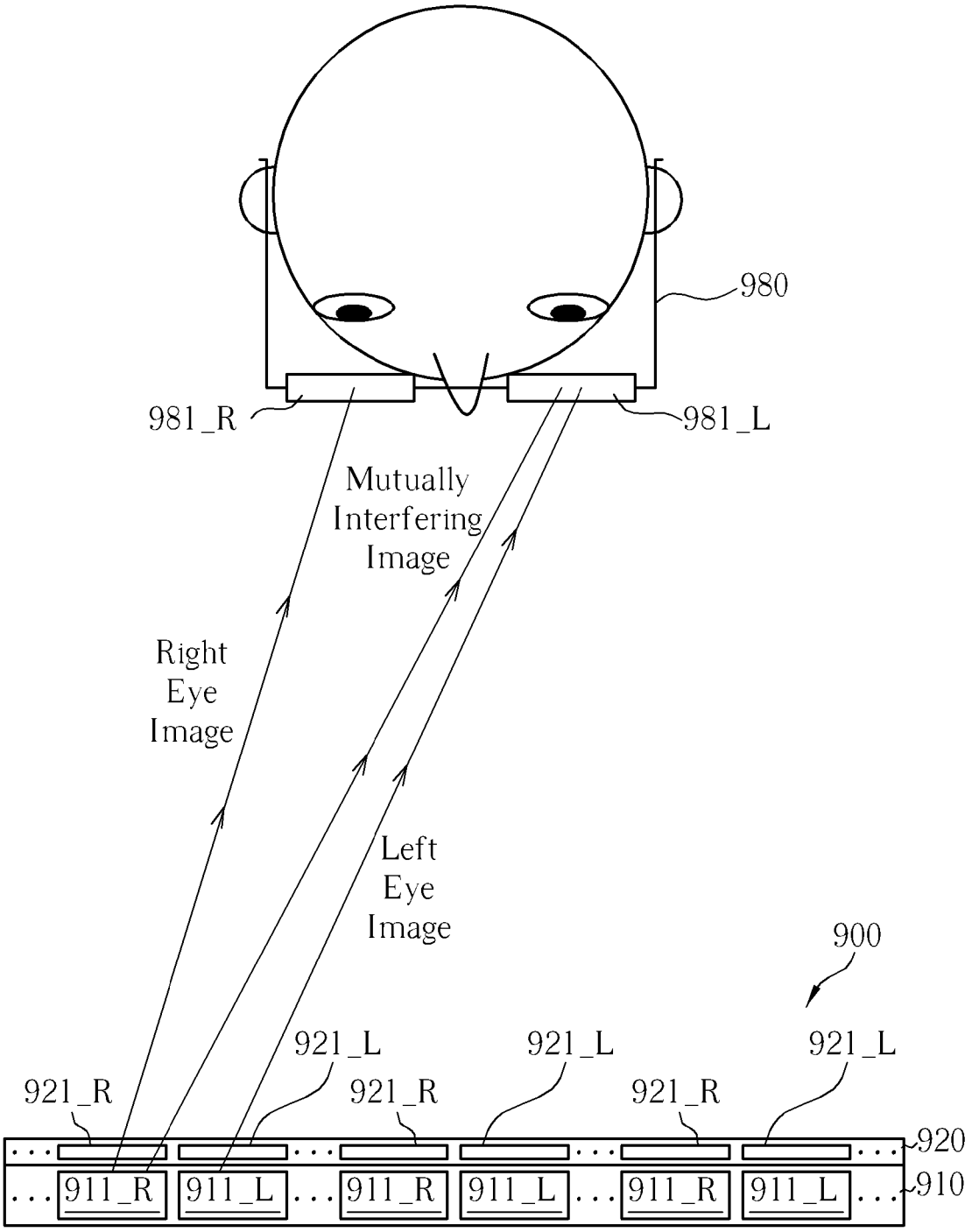
FIG. 1 PRIOR ART
FIG. 1 is a diagram illustrating architecture and method of use of a 3D display device.
Figure 2:
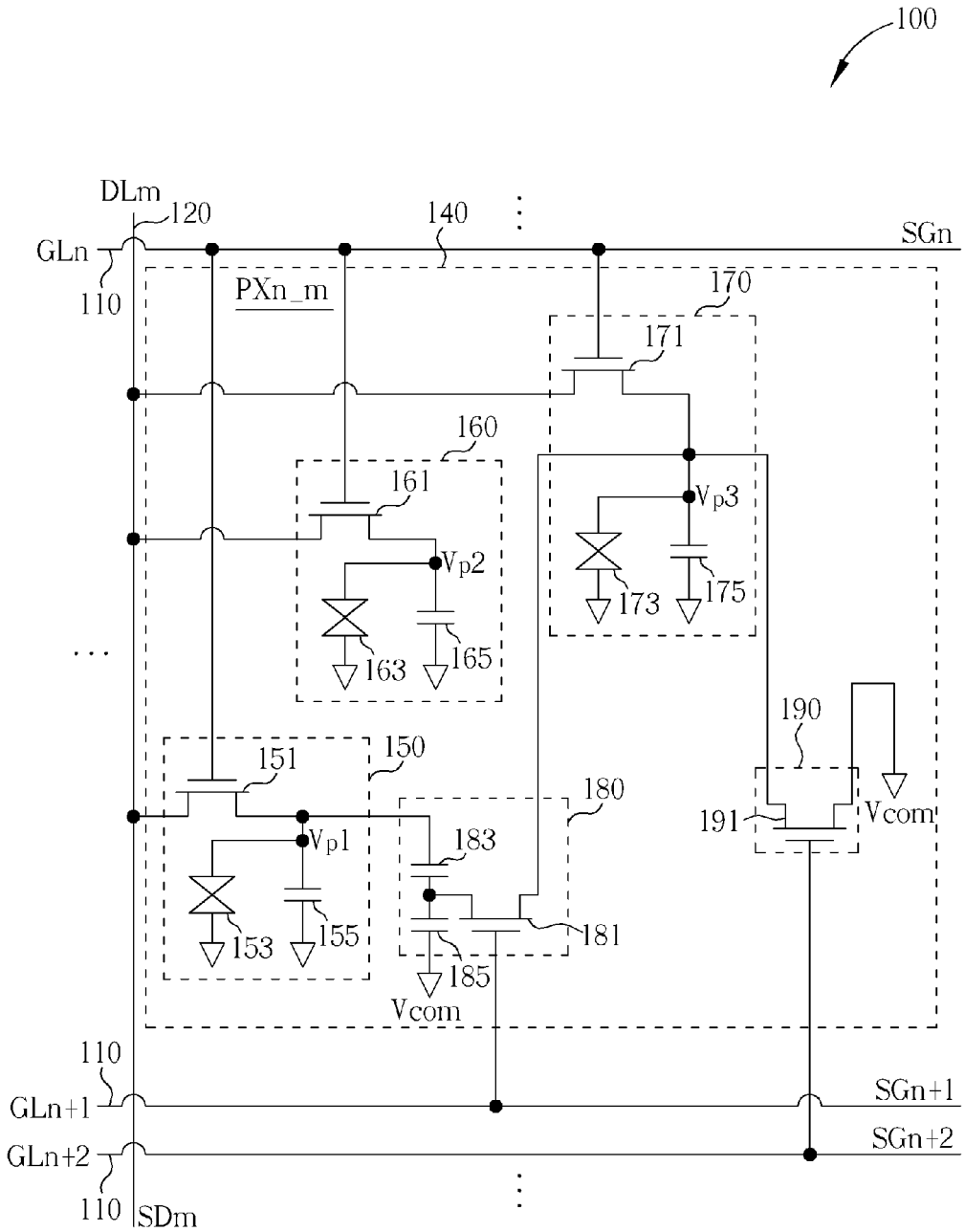
FIG. 2 is a circuit diagram of an LCD device according to an embodiment.

FIG. 2 is a circuit diagram of an LCD device according to an embodiment. As shown in FIG. 2, LCD device 100 comprises a plurality of gate lines 110, a plurality of data lines 120, and a plurality of pixels 140. Each pixel 140 is electrically connected to one corresponding data line 120 and three corresponding gate lines 110. For example, pixel PXn_m is electrically connected to data line DLm used for transmitting data signal SDm, gate line GLn used for transmitting gate signal SGn, gate line GLn+1 used for transmitting gate signal SGn+1, and gate line GLn+2 used for transmitting gate signal SGn+2. Pixel PXn_m comprises first sub-pixel unit 150, second sub-pixel unit 160, third sub-pixel unit 170, charge sharing control unit 180, and reset unit 190, where second sub-pixel unit 160 is installed between first sub-pixel unit 150 and third sub-pixel unit 170.

First sub-pixel unit 150 electrically connected to data line DLm and gate line GLn is used for being written to by first sub-pixel voltage Vp1 according to data signal SDm and gate signal SGn. Second sub-pixel unit 160 electrically connected to data line DLm and gate line GLn is used for being written to by second sub-pixel voltage Vp2 according to data signal SDm and gate signal SGn. Third sub-pixel unit 170 electrically connected to data line DLm and gate line GLn is used for being written to by third sub-pixel voltage Vp3 according to data signal SDm and gate signal SGn. Charge sharing control unit 180 electrically connected to gate line GLn+1, first sub-pixel unit 150 and third sub-pixel unit 170 is used for controlling charge-sharing operation between first sub-pixel unit 150 and third sub-pixel unit 170 according to gate signal SGn+1, and thereby adjusting first sub-pixel voltage Vp1 and third sub-pixel voltage Vp3 for accordingly performing Multi-domain Vertical Alignment (MVA) operation to achieve wide viewing angle display. Reset unit 190 electrically connected to gate line GLn+2 and third sub-pixel unit 170 is used for according to gate signal SGn+2 resetting third sub-pixel voltage Vp3 to common voltage Vcom to accordingly prevent mutual interference during 3D display operation.

In the embodiment of FIG. 2, first sub-pixel unit 150 comprises first transistor 151, first liquid crystal capacitor 153 and first storage capacitor 155, second sub-pixel unit 160 comprises second transistor 161, second liquid crystal capacitor 163 and second storage capacitor 165, third sub-pixel unit 170 comprises third transistor 171, third liquid crystal capacitor 173 and third storage capacitor 175, charge sharing control unit 180 comprises fourth transistor 181, first capacitor 183, and second capacitor 185, and reset unit 190 comprises fifth transistor 191. Please note that each transistor described above or in the following may be a Thin Film Transistor (TFT), a Field Effect Transistor (FET), or other component having switching functionality.

First transistor 151 has first terminal electrically connected to data line DLm, gate terminal electrically connected to gate line GLn, and second terminal electrically connected to first liquid crystal capacitor 153 and first storage capacitor 155. Second transistor 161 has first terminal electrically connected to data line DLm, gate terminal electrically connected to gate line GLn, and second terminal electrically connected to second liquid crystal capacitor 163 and second storage capacitor 165. Third transistor 171 has first terminal electrically connected to data line DLm, gate terminal electrically connected to gate line GLn, and second terminal electrically connected to third liquid crystal capacitor 173 and third storage capacitor 175. First capacitor 183 has first terminal electrically connected to second terminal of first transistor 151, and second terminal electrically connected to fourth transistor 181 and second capacitor 185. Second capacitor 185 has first terminal electrically connected to second terminal of first capacitor 183, and second terminal used for receiving common voltage Vcom. Fourth transistor 181 has first terminal electrically connected to second terminal of first capacitor 183, gate terminal electrically connected to gate line GLn+1, and second terminal electrically connected to second terminal of third transistor 171. Fifth transistor 191 has first terminal electrically connected to second terminal of third transistor 171, gate terminal electrically connected to gate line GLn+2, and second terminal used for receiving common voltage Vcom.

Figure 3:
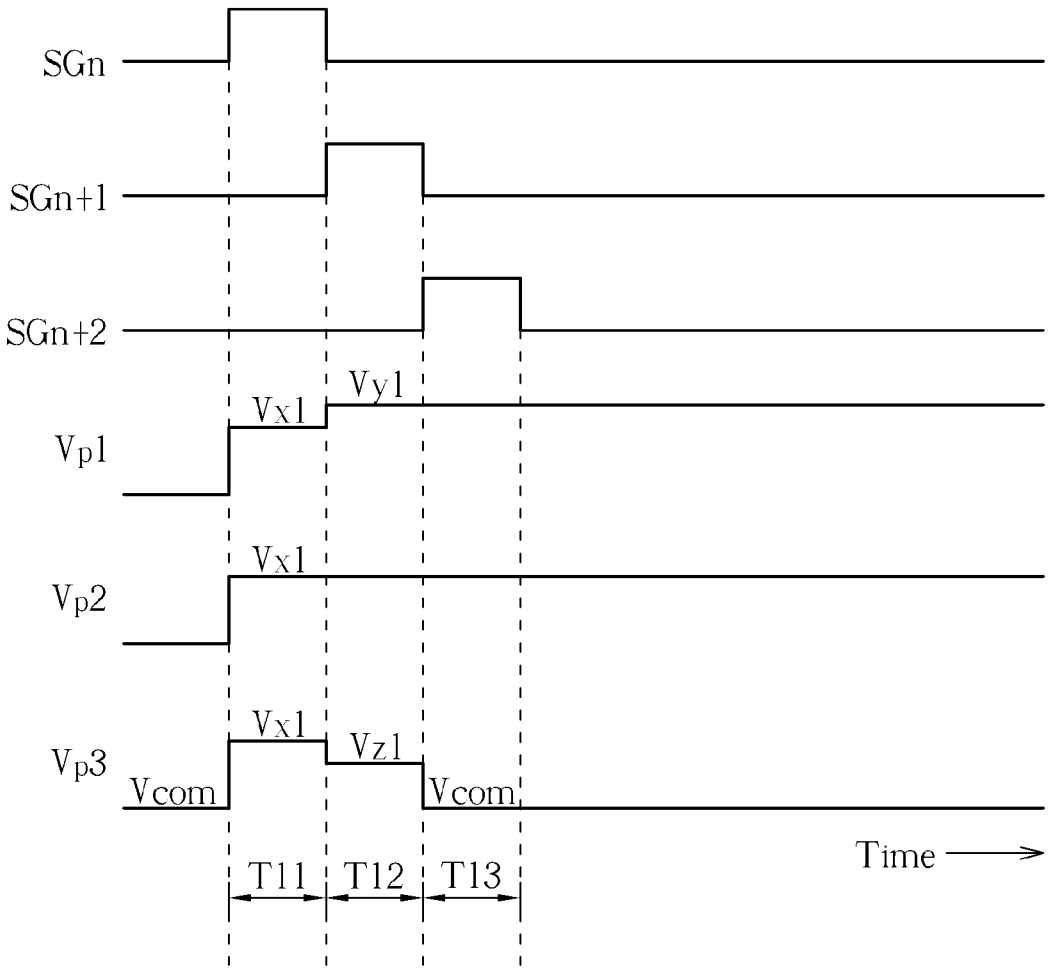
FIG. 3 is a waveform diagram of signals related to the LCD device of FIG. 2 using a display driving method according to an embodiment.

FIG. 3 is a waveform diagram of signals related to the LCD device of FIG. 2 using a first display driving method according to an embodiment. The horizontal axis represents time. In FIG. 3, signals from top to bottom are gate signal SGn, gate signal SGn+1, gate signal SGn+2, first sub-pixel voltage Vp1, second sub-pixel voltage Vp2, and third sub-pixel voltage Vp3. In period T11, gate pulse of gate signal SGn causes first transistor 151, second transistor 161 and third transistor 171 to conduct, thereby performing writing of data signal SDm, and accordingly setting first sub-pixel voltage Vp1, second sub-pixel voltage Vp2 and third sub-pixel voltage Vp3 to voltage Vx1. In period T12, gate pulse of gate signal SGn+1 causes fourth transistor 181 to conduct, and accordingly perform charge-sharing between first sub-pixel unit 150 and third sub-pixel unit 170. At that time, first sub-pixel voltage Vp1 is adjusted to voltage Vy1 different from voltage Vx1, third sub-pixel voltage Vp3 is adjusted to voltage Vz1 different from both voltage Vx1 and voltage Vy1. In period T13, gate pulse of gate signal SGn+2 causes fifth transistor 191 to conduct, thereby resetting third sub-pixel voltage Vp3 to common voltage Vcom. At that time, third sub-pixel unit 170 located in border region of pixel PXn_m is used for providing shielding, thereby preventing mutual interference, and raising 3D display quality. Additionally, first sub-pixel voltage Vp1 and second sub-pixel voltage Vp2 that are different from each other may accordingly perform 8-region MVA wide viewing angle operation. Namely, LCD device 100 based on the display driving method described is suitable for performing high quality wide viewing angle 3D display operation.

Figure 4:
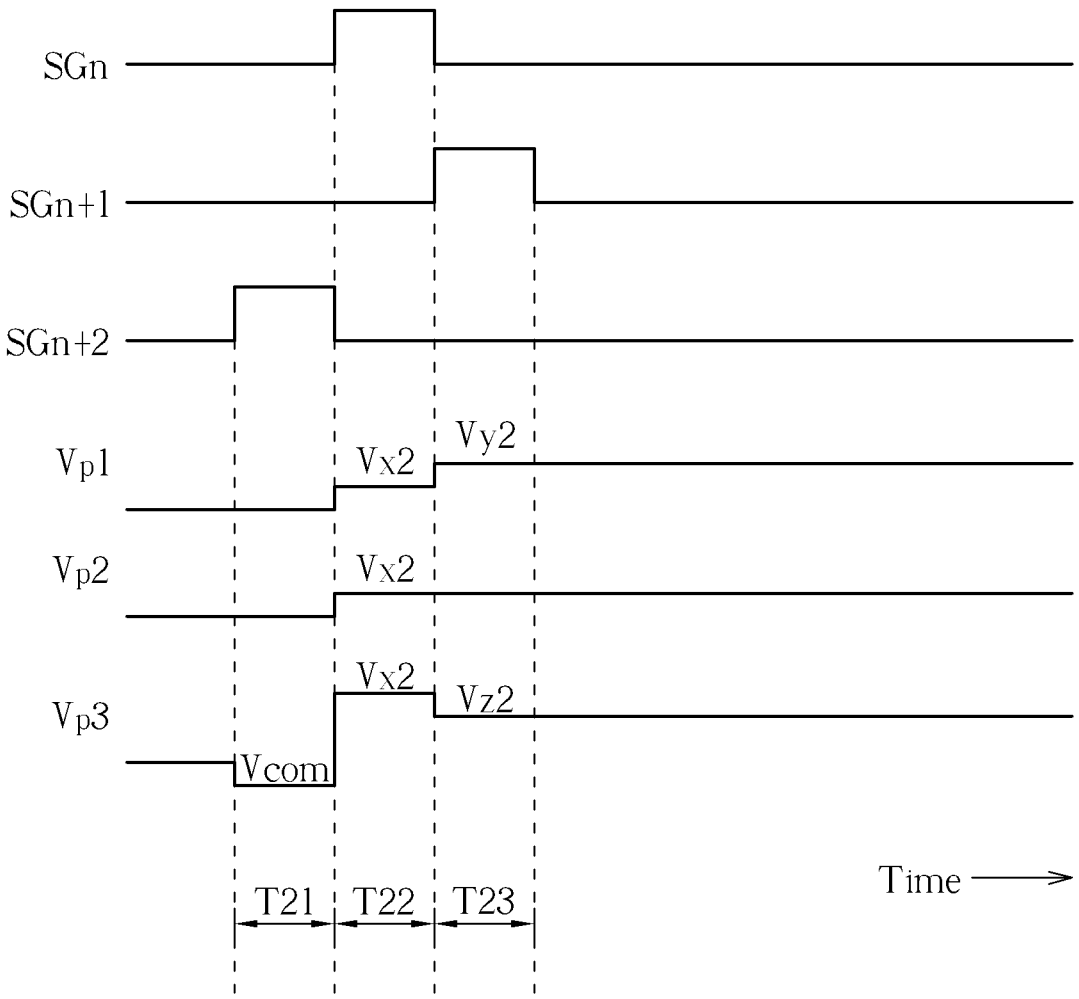
FIG. 4 is a waveform diagram showing signals related to the LCD device of FIG. 2 using another display driving method.

FIG. 4 is a waveform diagram showing signals related to the LCD device of FIG. 2 using a second display driving method. The horizontal axis represents time. In FIG. 4, signals from top to bottom are gate signal SGn, gate signal SGn+1, gate signal SGn+2, first sub-pixel voltage Vp1, second sub-pixel voltage Vp2, and third sub-pixel voltage Vp3. In period T21, gate pulse of gate signal SGn+2 causes fifth transistor 191 to conduct, thereby resetting third sub-pixel voltage Vp3 to common voltage Vcom. In period T22, gate pulse of gate signal SGn causes first transistor 151, second transistor 161 and third transistor 171 to conduct, thereby performing writing of data signal SDm, and accordingly setting first sub-pixel voltage Vp1, second sub-pixel voltage Vp2 and third sub-pixel voltage Vp3 to voltage Vx2. In period T23, gate pulse of gate signal SGn+1 causes fourth transistor 181 to conduct, accordingly performing charge sharing between first sub-pixel unit 150 and third sub-pixel unit 170. At that time, first sub-pixel voltage Vp1 is adjusted to voltage Vy2 different from voltage Vx2, third sub-pixel voltage Vp3 is adjusted to voltage Vz2 different from both voltage Vx2 and voltage Vy2, and first sub-pixel voltage Vp1, second sub-pixel voltage Vp2 and third sub-pixel voltage Vp3 that are all different from each other can accordingly perform 12-region MVA wide viewing angle operation. Namely, LCD device 100 based on this driving method is suitable for performing high quality, wide viding angle 2D display operation. LCD device 100 can perform display having 2D/3D switching functionality and MVA wide viewing angle functionality by using the first and second display driving methods described above.

Figure 5:
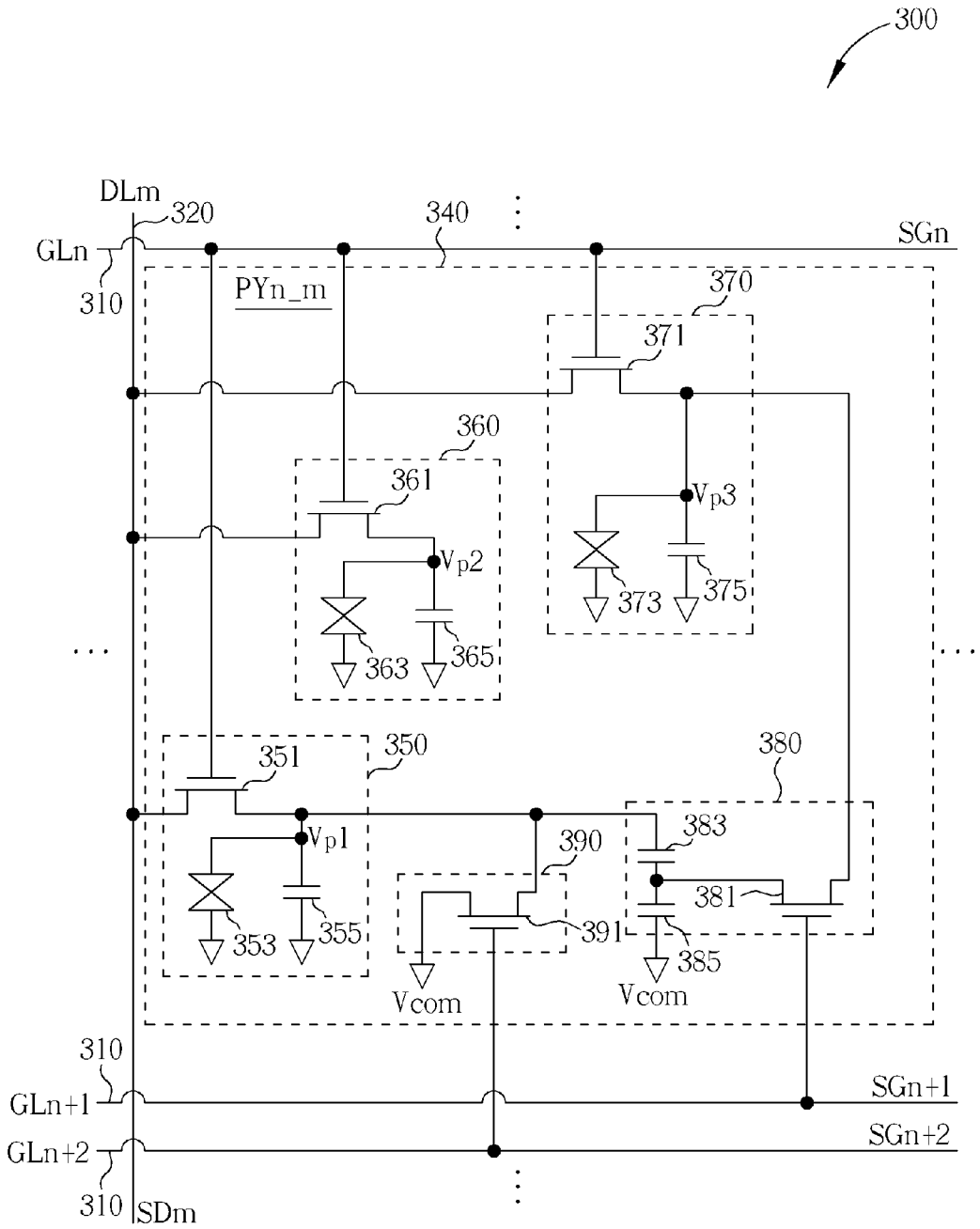
FIG. 5 is a circuit diagram of an LCD device according to an embodiment.

FIG. 5 is a circuit diagram of an LCD device according to an embodiment. As shown in FIG. 5, LCD device 300 comprises a plurality of gate lines 310, a plurality of data lines 320, and a plurality of pixels 340. Each pixel 340 is electrically connected to one corresponding data line 320 and three corresponding gate lines 310. For example, pixel PYn_m is electrically connected to data line DLm used for transmitting data signal SDm, gate line GLn used for transmitting gate signal SGn, gate line GLn+1 used for transmitting gate signal SGn+1, and gate line GLn+2 used for transmitting gate signal SGn+2. Pixel PYn_m comprises first sub-pixel unit 350, second sub-pixel unit 360, third sub-pixel unit 370, charge sharing control unit 380, and reset unit 390, where second sub-pixel unit 360 is installed between first sub-pixel unit 350 and third sub-pixel unit 370.

First sub-pixel unit 350 electrically connected to data line DLm and gate line GLn is being written to by first sub-pixel voltage Vp1 according to data signal SDm and gate signal SGn. Second sub-pixel unit 360 electrically connected to data line DLm and gate line GLn is used for being written to by second sub-pixel voltage Vp2 according to data signal SDm and gate signal SGn. Third sub-pixel unit 370 electrically connected to data line DLm and gate line GLn is used for being written to by third sub-pixel voltage Vp3 according to data signal SDm and gate signal SGn. Charge sharing control unit 380 electrically connected to gate line GLn+1, first sub-pixel unit 350 and third sub-pixel unit 370 is used for controlling charge sharing between first sub-pixel unit 350 and third sub-pixel unit 370 according to gate signal SGn+1, thereby adjusting first sub-pixel voltage Vp1 and third sub-pixel voltage Vp3, accordingly performing MVA to achieve wide viewing angle display functionality. Reset unit 390 electrically connected to gate line GLn+2 and first sub-pixel unit 350 is used for resetting first sub-pixel voltage Vp1 to common voltage Vcom according to gate signal SGn+2, accordingly preventing mutual interference during 3D display operation.

In the embodiment shown in FIG. 5, first sub-pixel unit 350 comprises first transistor 351, first liquid crystal capacitor 353 and first storage capacitor 355, second sub-pixel unit 360 comprises second transistor 361, second liquid crystal capacitor 363 and second storage capacitor 365, third sub-pixel unit 370 comprises third transistor 371, third liquid crystal capacitor 373 and third storage capacitor 375, charge sharing control unit 380 comprises fourth transistor 381, first capacitor 383 and second capacitor 385, and reset unit 390 comprises fifth transistor 391. First transistor 351 has first terminal electrically connected to data line DLm, gate terminal electrically connected to gate line GLn, and second terminal electrically connected to first liquid crystal capacitor 353 and first storage capacitor 355. Second transistor 361 has first terminal electrically connected to data line DLm, gate terminal electrically connected to gate line GLn, and second terminal electrically connected to second liquid crystal capacitor 363 and second storage capacitor 365. Third transistor 371 has first terminal electrically connected to data line DLm, gate terminal electrically connected to gate line GLn, and second terminal electrically connected to third liquid crystal capacitor 373 and third storage capacitor 375. First capacitor 383 has first terminal electrically connected to second terminal of first transistor 351, and second terminal electrically connected to fourth transistor 381 and second capacitor 385. Second capacitor 385 has first terminal electrically connected to second terminal of first capacitor 383, and second terminal used for receiving common voltage Vcom. Fourth transistor 381 has first terminal electrically connected to second terminal of first capacitor 383, gate terminal electrically connected to gate line GLn+1, and second terminal electrically connected to second terminal of third transistor 371. Fifth transistor 391 has first terminal electrically connected to second terminal of first transistor 351, gate terminal electrically connected to gate line GLn+2, and second terminal used for receiving common voltage Vcom.

Figure 6:
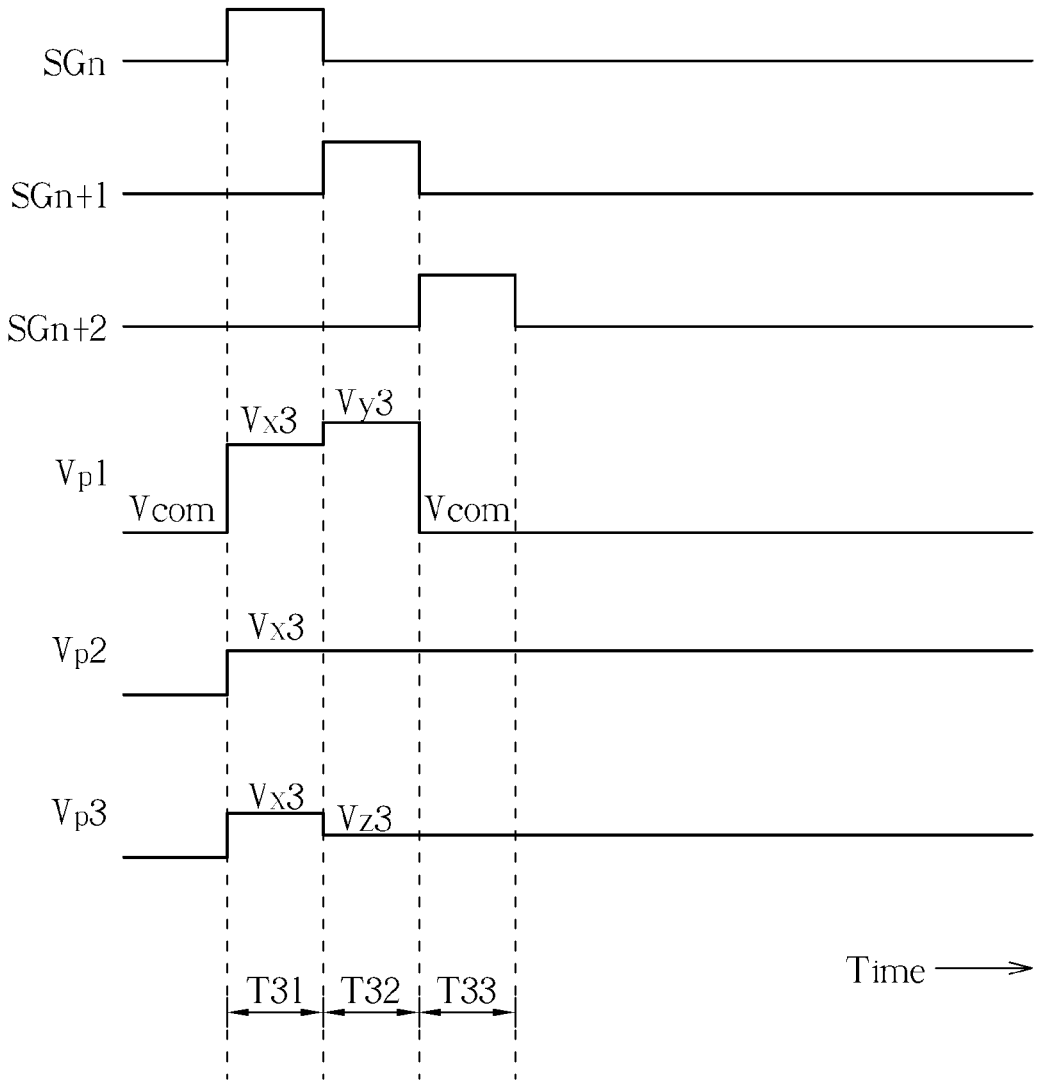
FIG. 6 is a waveform diagram showing signals related to the LCD device of FIG. 5 using the first display driving method.

FIG. 6 is a waveform diagram showing signals related to the LCD device of FIG. 5 using the first display driving method. The horizontal axis represents time. In FIG. 6, signals from top to bottom are gate signal SGn, gate signal SGn+1, gate signal SGn+2, first sub-pixel voltage Vp1, second sub-pixel voltage Vp2, and third sub-pixel voltage Vp3. In period T31, gate pulse of gate signal SGn causes first transistor 351, second transistor 361 and third transistor 371 to conduct, thereby performing writing of data signal SDm, accordingly setting first sub-pixel voltage Vp1, second sub-pixel voltage Vp2 and third sub-pixel voltage Vp3 to voltage Vx3. In period T32, gate pulse of gate signal SGn+1 causes fourth transistor 381 to conduct, accordingly performing charge sharing between first sub-pixel unit 350 and third sub-pixel unit 370. At that time, first sub-pixel voltage Vp1 is adjusted to voltage Vy3 different from voltage Vx3, and third sub-pixel voltage Vp3 is adjusted to voltage Vz3 that is different from voltage Vx3 and voltage Vy3. In period T33, gate pulse of gate signal SGn+2 causes fifth transistor 391 to conduct, thereby resetting first sub-pixel voltage Vp1 to common voltage Vcom. At that time, first sub-pixel unit 350 located in border region of pixel PYn_m is used for providing shielding, so that mutual interference is prevented, and 3D display quality is improved. Additionally, second sub-pixel voltage Vp2 and third sub-pixel voltage Vp3 that are different from each other can accordingly perform 8-region MVA wide viewing angle operation. Namely, LCD device 300 based on the first display driving method is suitable for performing high quality, wide viewing angle 3D display operation.

Figure 7:
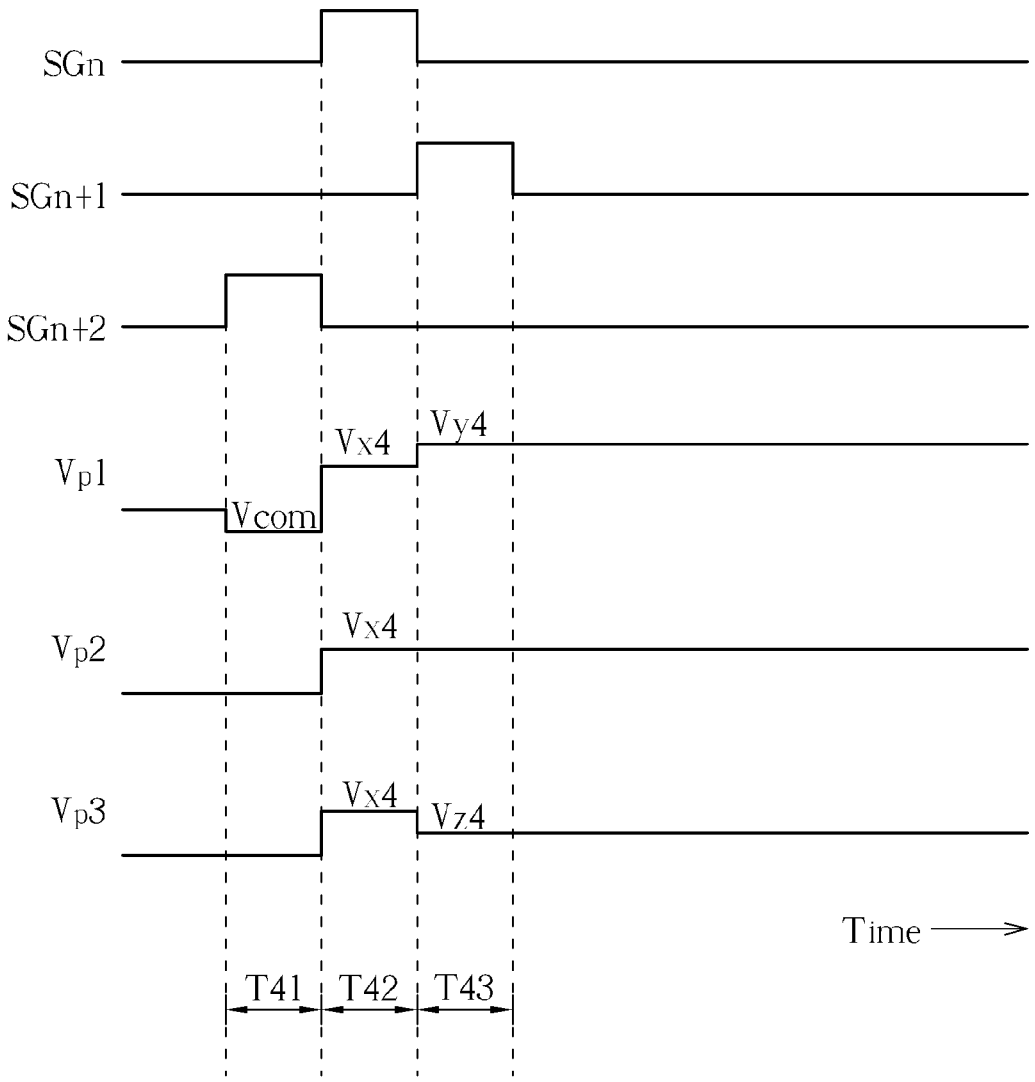
FIG. 7 is a waveform diagram showing signals related to the LCD device of FIG. 5 using the second display driving method.

FIG. 7 is a waveform diagram showing signals related to the LCD device of FIG. 5 using the second display driving method. The horizontal axis represents time. In FIG. 7, signals from top to bottom are gate signal SGn, gate signal SGn+1, gate signal SGn+2, first sub-pixel voltage Vp1, second sub-pixel voltage Vp2, and third sub-pixel voltage Vp3. In period T41, gate pulse of gate signal SGn+2 causes fifth transistor 391 to conduct, thereby resetting first sub-pixel voltage Vp1 to common voltage Vcom. In period T42, gate pulse of gate signal SGn causes first transistor 351, second transistor 361 and third transistor 371 to conduct, thereby performing writing of data signal SDm, accordingly setting first sub-pixel voltage Vp1, second sub-pixel voltage Vp2 and third sub-pixel voltage Vp3 to voltage Vx4. In period T43, gate pulse of gate signal SGn+1 causes fourth transistor 381 to conduct, accordingly performing charge sharing between first sub-pixel unit 350 and third sub-pixel unit 370. At that time, first sub-pixel voltage Vp1 is adjusted to voltage Vy4 different from voltage Vx4, third sub-pixel voltage Vp3 is adjusted to voltage Vz4 different from both voltage Vx4 and voltage Vy4, and first sub-pixel voltage Vp1, second sub-pixel voltage Vp2 and third sub-pixel voltage Vp3 that are different from each other can accordingly perform 12-region MVA wide viewing angle operation. Namely, LCD device 300 based on the second display driving method is suitable for performing high quality, wide viewing angle 2D display operation. LCD device 300 can perform display having 2D/3D switching functionality and MVA wide viewing angle functionality by using the first and second display driving methods described above.

Please note that number of sub-pixel units in each pixel of the LCD devices is not limited in the embodiments. Namely, the shielding mechanism used for improving 3D display quality can be extended to pixel circuit designs based on even more sub-pixel units. The LCD devices and related display driving methods can be used for performing 8-region MVA wide viewing angle 3D display operation, and can be used for performing 12-region MVA wide viewing angle 2D display operation. Additionally, when performing 3D display operation, the LCD devices and related driving methods prevent mutual interference to improve display quality. Namely, the LCD devices can use the related display driving methods to perform high quality display operation having 2D/3D switching functionality and MVA wide viewing angle functionality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD) device comprising:

a data line for transmitting a data signal;

a first gate line for transmitting a first gate signal;

a second gate line for transmitting a second gate signal;

a third gate line for transmitting a third gate signal;

a first sub-pixel unit electrically connected to the data line and the first gate line, wherein the first sub-pixel unit is used for being written to by a first sub-pixel voltage according to the data signal and the first gate signal;

a second sub-pixel unit electrically connected to the data line and the first gate line, wherein the second sub-pixel unit is used for being written to by a second sub-pixel voltage according to the data signal and the first gate signal;

a third sub-pixel unit electrically connected to the data line and the first gate line, wherein the third sub-pixel unit is used for being written to by a third sub-pixel voltage according to the data signal and the first gate signal;

a reset unit electrically connected to the third gate line and the third sub-pixel unit, the reset unit being used for resetting the third sub-pixel voltage to a common voltage according to the third gate signal; and a charge sharing control unit controlling charge sharing between the first sub-pixel unit and the third sub-pixel unit according to the second gate signal, the charge sharing control unit comprising:

a first capacitor having a first terminal electrically connected to the first sub-pixel unit, and a second terminal;

a second capacitor having a first terminal directly connected to the second terminal of the first capacitor, and a second terminal for receiving the common voltage; and a transistor having a first terminal electrically connected to the second terminal of the first capacitor, a gate terminal electrically connected to the second gate line, and a second terminal electrically connected to the third sub-pixel unit.

2. The LCD device of claim 1, wherein the second sub-pixel unit is positioned between the first sub-pixel unit and the third sub-pixel unit.

3. The LCD device of claim 1, wherein the reset unit comprises a transistor having a first terminal electrically connected to the third sub-pixel unit, a gate terminal electrically connected to the third gate line, and a second terminal for receiving the common voltage.

4. The LCD device of claim 1, wherein the first sub-pixel unit comprises:

a transistor having a first terminal electrically connected to the data line, a gate terminal electrically connected to the first gate line, and a second terminal electrically connected to the charge sharing control unit; and a liquid crystal capacitor electrically connected to the second terminal of the transistor.

5. The LCD device of claim 1, wherein the second sub-pixel unit comprises:

a transistor having a first terminal electrically connected to the data line, a gate terminal electrically connected to the first gate line, and a second terminal; and a liquid crystal capacitor electrically connected to the second terminal of the transistor.

6. The LCD device of claim 1, wherein the third sub-pixel unit comprises:

a transistor having a first terminal electrically connected to the data line, a gate terminal electrically connected to the first gate line, and a second terminal electrically connected to the charge sharing control unit; and a liquid crystal capacitor electrically connected to the second terminal of the transistor.

7. A liquid crystal display (LCD) device comprising:

a data line for transmitting a data signal;

a first gate line for transmitting a first gate signal;

a second gate line for transmitting a second gate signal;

a first sub-pixel unit electrically connected to the data line and the first gate line, wherein the first sub-pixel unit is used for being written to by a first sub-pixel voltage according to the data signal and the first gate signal;

a second sub-pixel unit electrically connected to the data line and the first gate line, wherein the second sub-pixel unit is used for being written to by a second sub-pixel voltage according to the data signal and the first gate signal;

a third sub-pixel unit electrically connected to the data line and the first gate line, wherein the third sub-pixel unit is used for being written to by a third sub-pixel voltage according to the data signal and the first gate signal; and a reset unit electrically connected to the second gate line, the reset unit being for performing a reset operation on the first sub-pixel voltage of the first sub-pixel unit or the third sub-pixel voltage of the third sub-pixel unit according to the second gate signal.

8. The LCD device of claim 7, wherein the second sub-pixel unit is positioned between the first sub-pixel unit and the third sub-pixel unit.

9. The LCD device of claim 7, wherein the reset unit comprises a transistor for performing a reset operation according to the second gate signal.

10. The LCD device of claim 7, wherein the first sub-pixel unit comprises:

a transistor having a first terminal electrically connected to the data line, a gate terminal electrically connected to the first gate line, and a second terminal electrically connected to the charge sharing control unit;

a liquid crystal capacitor electrically connected to the second terminal of the transistor; and a storage capacitor electrically connected to the second terminal of the transistor.

11. A method of driving a display for use in driving an LCD device having a 2D/3D switching mechanism and a Multi-domain Vertical Alignment (MVA) mechanism, the LCD device comprising a data line for transmitting a data signal, a first gate line for transmitting a first gate signal, a second gate line for transmitting a second gate signal, a third gate line for transmitting a third gate signal, a first sub-pixel unit electrically connected to the data line and the first gate line, a second sub-pixel unit electrically connected to the data line and the first gate line, a third sub-pixel unit electrically connected to the data line and the first gate line, a charge sharing control unit for controlling charge sharing between the first sub-pixel unit and the third sub-pixel unit according to the second gate signal, and a reset unit for performing a reset operation according to the third gate signal to reset the first sub-pixel voltage or the third sub-pixel voltage, the method comprising:

in a first period, providing a first gate pulse of the first gate signal to the first gate line for writing the data signal to the first sub-pixel unit, the second sub-pixel unit, and the third sub-pixel unit;

in a second period following the first period, providing a second gate pulse of the second gate signal to the second gate line for enabling the charge sharing control unit; and in a third period following the second period, providing a third gate pulse of the third gate signal to the third gate line for enabling the reset unit.

12. A method of driving a display for use in driving an LCD device having a 2D/3D switching mechanism and a Multi-domain Vertical Alignment (MVA) mechanism, the LCD device comprising a data line for transmitting a data signal, a first gate line for transmitting a first gate signal, a second gate line for transmitting a second gate signal, a third gate line for transmitting a third gate signal, a first sub-pixel unit electrically connected to the data line and the first gate line, a second sub-pixel unit electrically connected to the data line and the first gate line, a third sub-pixel unit electrically connected to the data line and the first gate line, a charge sharing control unit for controlling charge sharing between the first sub-pixel unit and the third sub-pixel unit according to the second gate signal, and a reset unit for performing a reset operation according to the third gate signal to reset the first sub-pixel voltage or the third sub-pixel voltage, the method comprising:

in a first period, providing a third gate pulse of the third gate signal to the third gate line for enabling the reset unit;

in a second period following the first period, providing a first gate pulse of the first gate signal to the first gate line for writing the data signal to the first sub-pixel unit, the second sub-pixel unit, and the third sub-pixel unit; and in a third period following the second period, providing a second gate pulse of the second gate signal to the second gate line for enabling the charge sharing control unit.

* * * * *